United States Patent [19]

Pawley

[11] 4,187,028

[45] Feb. 5, 1980

[54] MIXING BLADE FOR CONCRETE MIXER

[75] Inventor: Jess W. Pawley, London, Canada

[73] Assignee: London Concrete Machinery Co., London, Canada

[21] Appl. No.: 957,936

[22] Filed: Nov. 6, 1978

[51] Int. Cl.[2] ..... B28C 5/18; B28C 7/16

[52] U.S. Cl. ..... 366/44; 366/54

[58] Field of Search ..... 366/44, 45, 46, 53, 366/50, 54, 64

[56] References Cited

U.S. PATENT DOCUMENTS

| | | | |
|---|---|---|---|
| 2,338,820 | 1/1944 | Peters | 366/44 X |
| 2,805,053 | 9/1957 | Smith | 366/44 |
| 3,038,705 | 6/1962 | McDermott | 366/44 |
| 3,567,189 | 3/1971 | Buelow | 366/44 |

*Primary Examiner*—Edward J. McCarthy

*Attorney, Agent, or Firm*—Fetherstonhaugh & Co.

[57] ABSTRACT

An improved and more rapid mixing of concrete is achieved in a rotary concrete mixing drum according to the present invention by the simple expedient of providing passages which open through the body of the mixing blade which permit concrete flow therethrough. The flow of concrete through the passages creates added turbulence in the body of concrete during the rotation of the mixing drum in the mixing direction. The concrete is prevented from passing directly through the same mixing passages when the mixing drum is rotated in the discharged direction by mounting deflector blades on the discharge face which extend over the mixing passages and deflect the concrete aggregate away from the mixing passages during rotation of the mixing blades in the discharge direction.

5 Claims, 4 Drawing Figures

MIXING BLADE FOR CONCRETE MIXER

This invention relates to improvements in eotary concrete mixing drums. In particular, this invention relates to improvements in mixing blades which serve to establish increased turbulence in the concrete which is mixed as the mixing blades are rotatably driven.

PRIOR ART

With the increased load carrying capacity of transit mixers, it has become increasingly important to ensure rapid and complete mixing of concrete occurs in transit. It is also important to be able to mix additives such as water into the concrete as quickly as possible at a job site. The problem of obtaining adequate mixing of concrete is encountered in concrete mixing drums of the type which are elongated to permit front end discharge from the transit vehicle as well as in the conventional short mixing drums.

I have found that an improved and more rapid mixing can be achieved by the simple expedient of providing passages which open through the body of the mixing blade which permit concrete to flow therethrough. The flow of concrete through the passages creates added turbulence in the body of concrete during the rotation of the mixing drum in the mixing direction. I prevent the concrete passing directly through these same mixing passages when the mixing drum is rotated in the discharge direction by mounting deflector blades on the discharge face which extend over the mixing passages and deflect the concrete over from the mixing passages during rotation of the mixing blades in the discharge direction. By this simple expedient, a substantial increase in turbulence is established within the mixing drum in both the mixing and discharge operations and as a consequence an improved and more rapid mixing of the concrete is achieved.

SUMMARY OF INVENTION

According to one aspect of the present invention, there is provided in a rotary concrete mixing drum mounted for rotation about a rotary axis, said mixing drum having a mixing chamber formed therein, said mixing chamber having a head end and a discharge end arranged opposite one another, a mixing blade disposed within said mixing chamber, said mixing blade having a mixing face directed toward said head end to establish a fluid flow in a direction toward said head end of said chamber in response to rotation of said blades in a mixing direction about said rotary axis and a discharge face directed toward the discharge end of said mixing drum to establish a fluid flow in a direction toward said discharge end of said chamber in response to rotation in said discharge direction, the improvement of a plurality of mixing passages opening through said mixing blade between said mixing face and said discharge face whereby wet concrete will pass through said mixing passages from said mixing face to said discharge face in response to rotation of said drum in said mixing direction and thereby establish turbulence in the mixing chamber, a deflector blade mounted on said discharge face of said mixing blade in advance of each mixing passage in the discharge direction, said deflector blade overlying at least a portion of its associated mixing passage and serving to deflect the flow of wet concrete away from its associated mixing passage to permit discharge of wet concrete from said discharge end in response to rotation in said discharge direction.

PREFERRED EMBODIMENT

The invention will be more clearly understood after reference to the following detailed specification read in conjunction with the drawings wherein.

Figure 1:
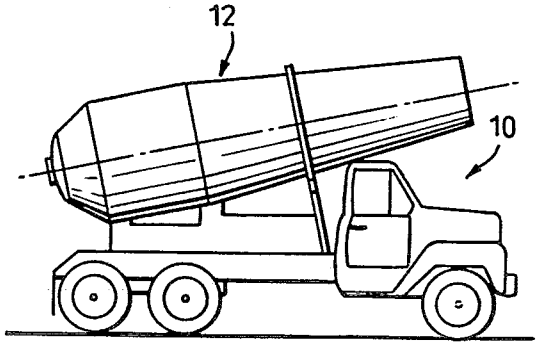
FIG. 1 is a side view of a transit mixer of the front end loading type.
Figure 3:
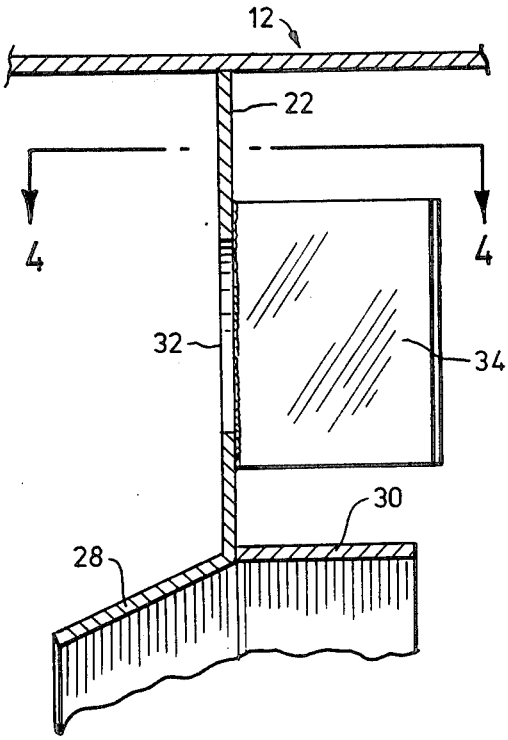
FIG. 3 is a sectional view in the direction of the arrow 3—3 of FIG. 2.

With reference to the drawings, reference numeral 10 refers generally to a transit mixer of the type on which a rotary mixing drum 12 is mounted for rotation. While the rotary mixing drum 12 of FIGS. 1 and 2 of the drawings is of the front end loading type, it will be noted that the present invention is not limited to use in association with a mixing drum of this type and is equally applicable to the conventional rotary mixing drums.

Figure 2:
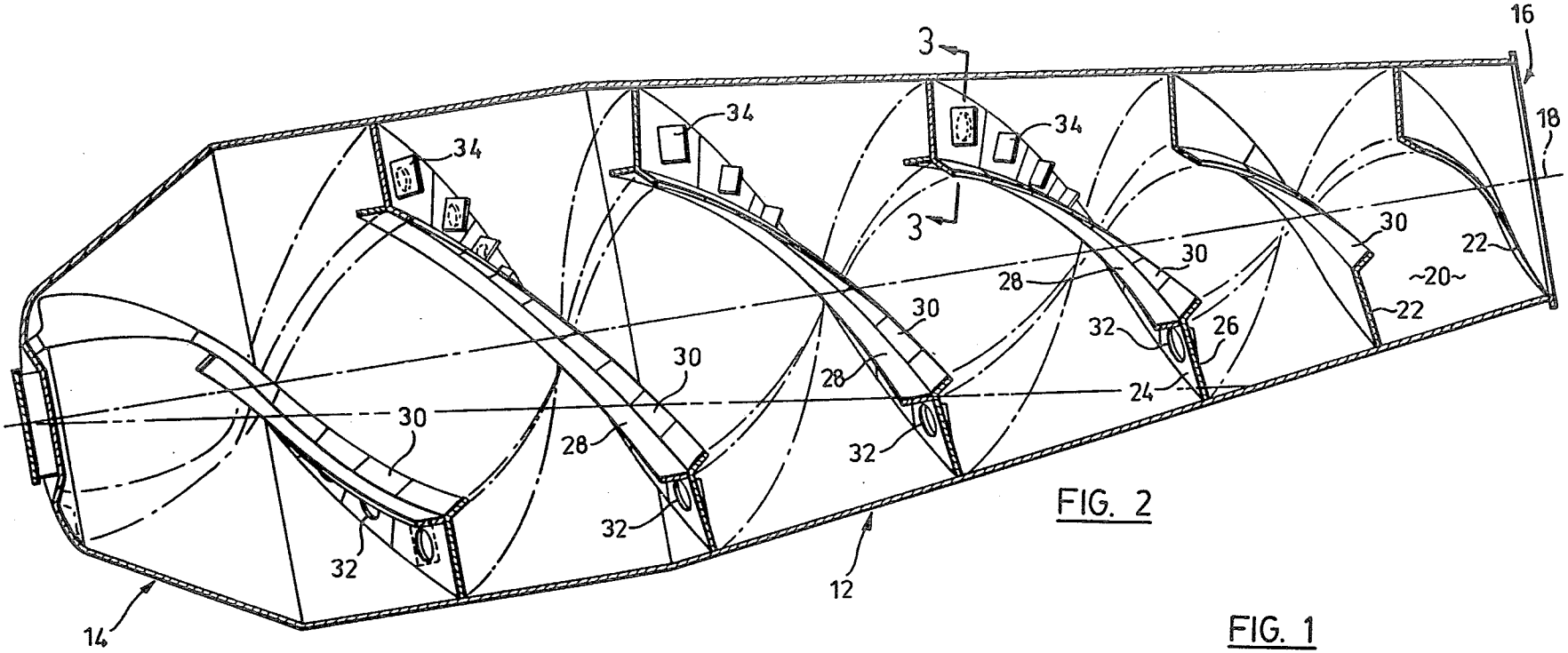
FIG. 2 is a sectional side view taken perpendicularly through the rotary mixing drum of FIG. 1.

As shown in FIG. 2 of the drawings, the rotary mixing drum 12 has a head end generally identified by the reference numeral 14 and a loading and discharge end generally identified by the reference numeral 16. The head end 14 is closed and the loading and discharge end 16 is open. The rotary drum 12 is mounted for rotation about a rotational axis 18 which is inclined upwardly in a direction toward the end 16.

The mixing drum 12 has a mixing chamber 20 located therein and a pair of mixing blades 22 extend spirally of the inner wall of the drum 16 from the loading and discharge end 16 thereof to the head end 14. Each mixing blade 22 has a mixing face 24 directed toward the head end 14 and discharge face 26 directed toward the discharge end 16. Rotation of the mixing drum 16 in a mixing direction causes the mixing face 24 of each mixing blade 22 to bear against the body of concrete located in the mixing drum and drive it toward the head end 14. Rotation of the mixing drum in the discharge direction causes the discharge face 26 of each mixing blade to bear against the body of concrete in the mixing chamber and establish a flow toward the discharge end 16. Each mixing blade 22 has loading and unloading flanges 28 and 30 respectively at the inner peripheral edge thereof which serve to facilitate loading and unloading of concrete as described in the applicant's copending application Ser. No. 957,868, filed Nov. 6, 1978.

The improvement of the present invention is in the provision of a plurality of mixing passages 32 and their associated deflector blades 34. The mixing passages 32 extend through the mixing blade from the mixing face 24 to the discharge face 26 thereof so that in response to rotation of the mixing blades in the mixing direction, concrete will be urged through the mixing passages 32 against the inner face of the deflector blades 34 to be deflected thereby. Passage of concrete through mixing passages 32 in itself establishes turbulence in the flow of wet concrete and this turbulence is further enhanced by the fact that the concrete which flows through the passages 32 is deflected from linear flow by deflector blades 34.

One would not normally provide passages in the mixing blade of a rotary concrete mixer as this would be expected to considerably inhibit the discharge of concrete from the mixing chamber and it is extremely important to make provision for the rapid discharge of concrete from the mixing chamber at a work site. Surprisingly, however, I have found that by the simple expedient of providing a deflector blade 34 mounted on the discharge face of the mixing blade 26 in advance of each mixing passage 32 in the discharge direction, it is possible to obtain a rapid discharge of concrete. The deflector blades 34 are upwardly and rearwardly inclined from the point at which they are welded to the blade 22 as shown in FIG. 4 of the drawings and have a length and width sufficient to substantially obscure the passage 32 so that during discharge rotation, the concrete will pass over the discharge blades 34 and not through the passages 32.

Figure 4:
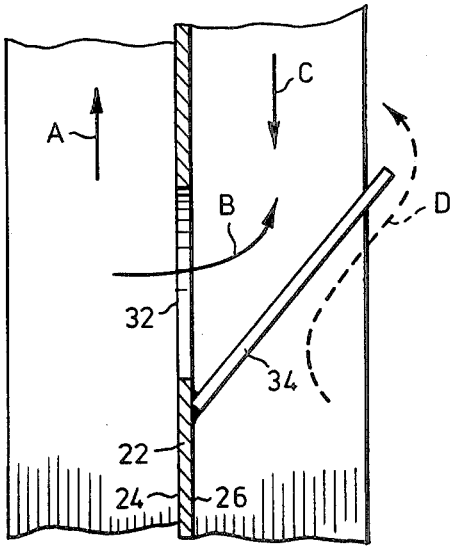
FIG. 4 is a sectional view in the direction of the arrow 4—4 of FIG. 3.

In use, rotation of the mixing drum 12 in the mixing direction of arrow A, FIG. 4 establishes a flow of the concrete in the lower end of the chamber 20 in a direction toward the head end 14 with the return flow extending at a level above the mixing blades 26. During rotation in the mixing direction concrete will also flow through the mixing passage 32 from the mixing face 24 to the discharge face 26 in the direction of the arrow B of FIG. 4. This flow through the passage 32 deflected by the blade 34 which serves to further increase the turbulence in the mixing action. In order to discharge concrete, the direction of rotation of the mixing drum is reversed to a discharge direction in the direction of arrow C of FIG. 4. Rotation of the mixing drum in the mixing direction causes flow of concrete along the mixing face 24 and over the deflector blades 34 in a direction of the arrow D of FIG. 4. Thus, it will be seen that the deflector blade 34 deflects the concrete flow away from the mixing passage 32 so that efficient discharge can be obtained.

From the foregoing, it will be apparent that the present invention provides for increased turbulence in the body of concrete which is being mixed during rotation of the drum in the mixing direction while the provision of the mixing passages does not inhibit the efficiency of the discharge to any great extent by reason of the provision of the deflector blades associated with each mixing passage.

Preferably, the mixing passages 32 and their associated deflector blades 34 are located at uniformly spaced intervals along the length of each mixing blade and extend over at least two thirds of the length of the mixing drum measured in a direction away from the head end thereof. The mixing passages 32 are preferably not provided in the area immediately adjacent the discharge end thereof and in the immediate area of the head end.

What I claim as my invention is:

1. In a rotary concrete mixing drum mounted for rotation about a rotary axis, said mixing drum having a mixing chamber formed therein, said mixing chamber having a head end and a discharge end arranged opposite one another, a mixing blade disposed within said mixing chamber, said mixing blade having a mixing face directed toward said head end to establish a fluid flow in a direction toward said head end of said chamber in response to rotation of said blades in a mixing direction about said rotary axis and a discharge face directed toward the discharge end of said mixing drum to establish a fluid flow in a direction toward said discharge end of said chamber in response to rotation in said discharge direction, the improvement of;

(a) a plurality of mixing passages opening through said mixing blade between said mixing face and said discharge face whereby wet concrete will pass through said mixing passages from said mixing face to said discharge face in response to rotation of said drum in said mixing direction and thereby establish turbulence in the mixing chamber, (b) a deflector blade mounted on said discharge face of said mixing blade in advance of each mixing passage in the discharge direction, said deflector blade being adapted to deflect the flow of wet concrete away from its associated mixing passage to permit discharge of wet concrete from said discharge end in response to rotation in said discharge direction.

2. A rotary concrete mixing drum as claimed in claim 1 wherein each deflector blade comprises a rigid blade which is upwardly and rearwardly inclined above its associated mixing passage.

3. A rotary concrete mixing drum as claimed in claim 1 wherein said mixing passages and their associated deflector blades are provided on each mixing blade of said rotary mixer.

4. A rotary concrete mixing drum as claimed in claim 1 wherein said mixing passages and their associted deflector blades are located at uniformly spaced intervals along the length of said mixing blade.

5. A rotary concrete mixing drum as claimed in claim 1 wherein said mixing passages and their associated deflector blades are located at spaced intervals over at least two thirds of the length of said mixing blade measured from said head end of said mixing chamber.

* * * * *